US005556091A

United States Patent [19]

Lin

[11] Patent Number: 5,556,091

[45] Date of Patent: Sep. 17, 1996

[54] BASEBALL HOLDER FOR BASEBALL BATTING PRACTICE

[76] Inventor: Mike Lin, No. 32, Lane 395, Shui Yuan Road, Nan Tsun Li, Fen Yuan City, Taichung, Taiwan

[21] Appl. No.: 490,254

[22] Filed: Jun. 14, 1995

[51] Int. Cl.[6] ..... A63B 69/40

[52] U.S. Cl. ..... 273/26 R

[58] Field of Search ..... 273/26 R, 29 R, 273/187 R, 187 B, 188 A

[56] References Cited

U.S. PATENT DOCUMENTS 4,227,691 10/1980 Lefebver ..... 273/26 R 4,796,885 1/1989 Wright ..... 273/26 R 4,830,371 5/1989 Lay ..... 273/26 R 5,076,580 12/1991 Lang ..... 273/26 R

*Primary Examiner*—Theatrice Brown

*Attorney, Agent, or Firm*—Donald C. Casey

[57] ABSTRACT

A baseball holder including a home plate having a pivot bolt at the center and a plurality of locating holes around the pivot bolt, a swivel mount turned about the pivot bolt and then secured to one locating hole by a spring-supported locating bolt thereof, and an upright support moved in longitudinal slots on the swivel mount to adjust the distance from the pivot bolt and then fixed in position for holding a baseball for batting.

1 Claim, 5 Drawing Sheets

BASEBALL HOLDER FOR BASEBALL BATTING PRACTICE

BACKGROUND OF THE INVENTION

The present invention relates to a ball holder for holding a baseball for batting practice which can be adjusted to change the position of the baseball radially from and around the center of the home plate for different batting challenges.

While exercising a baseball batting practice, a baseball holder may be used to hold a baseball for batting. FIG. 1 shows a baseball holder for this purpose. This baseball holder comprises a home plate (B) and an upright support (A) raised from the center of the home plate (B). The upright support (A) is comprised of a bottom section (A1) secured to the home plate (B), a top section (A2) adjustably connected to the bottom section (A1) by a screw joint, and a flexible tee (A21) at the top of the top section (A2) for holding a baseball. This structure of baseball holder can only hold a baseball at the center of the home plate, therefore it is not suitable for different batting practice. Because a pitcher will throw the ball in different directions over the home plate, it is necessary to frequently change the position of the baseball during a batting practice. However, the aforesaid structure of baseball holder can not meet this requirement.

SUMMARY OF THE INVENTION

The present invention has been accomplished under the circumstances in view. It is therefore the principal object of the present invention to provide a baseball holder for baseball batting practice which can be conveniently adjusted to change the position of the baseball radially from and around the center of the home plate for different batting challenges. According to the preferred embodiment of the present invention, the baseball holder comprises a home plate having a pivot bolt at the center and a plurality of locating holes around the pivot bolt, a swivel mount turned about the pivot bolt and then secured to one locating hole by a spring-supported locating bolt thereof, and an upright support moved in longitudinal slots on the swivel mount to adjust the distance from the pivot bolt and then fixed in position for holding a baseball for batting.

DETAILED DESCRIPTION OF THE PREFERRED EMBODIMENT

Figure 1:
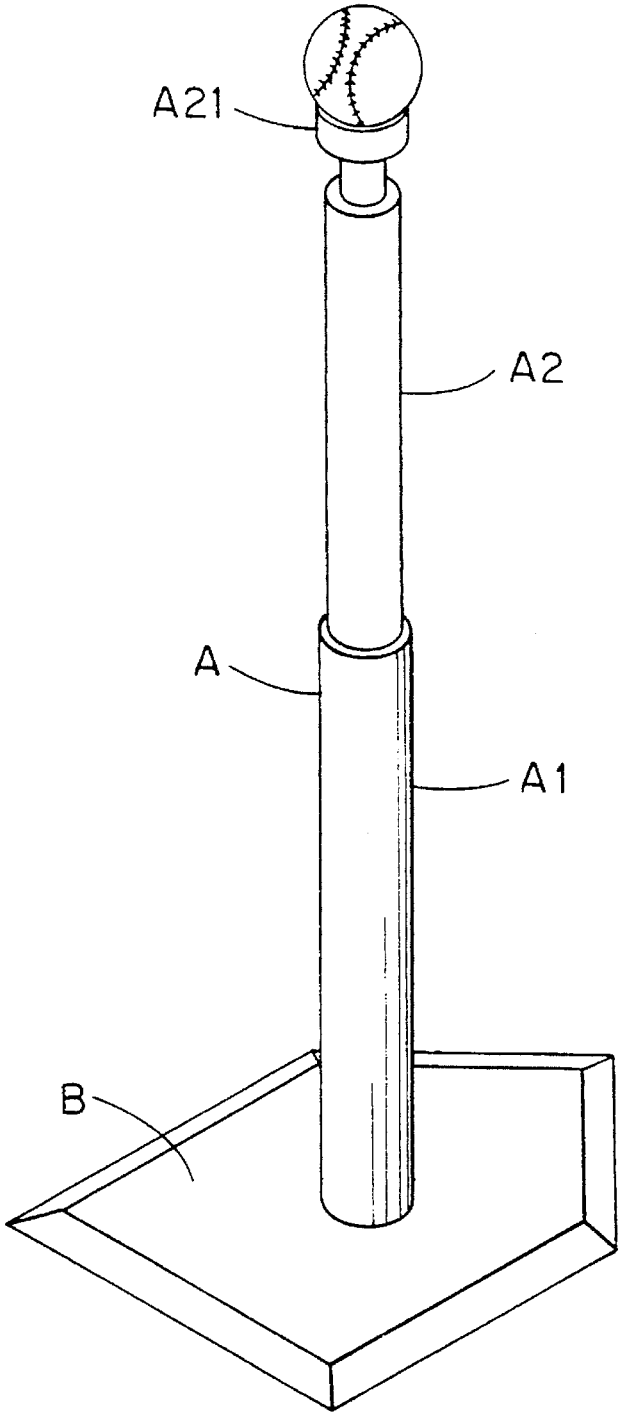
FIG. 1 is an elevational view of a baseball holder for baseball batting practice according to the prior art.
Figure 2:
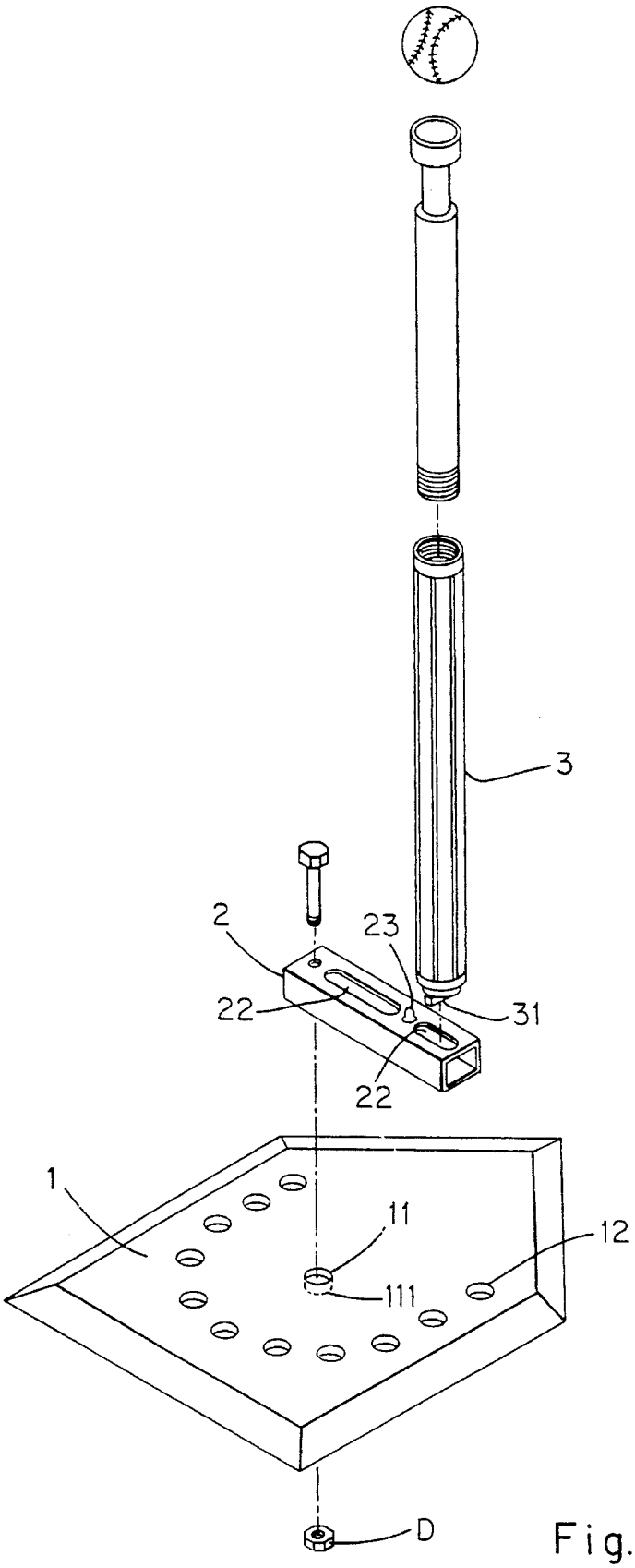
FIG. 2 is an exploded view of a baseball holder for baseball batting practice according to the present invention.
Figure 3:
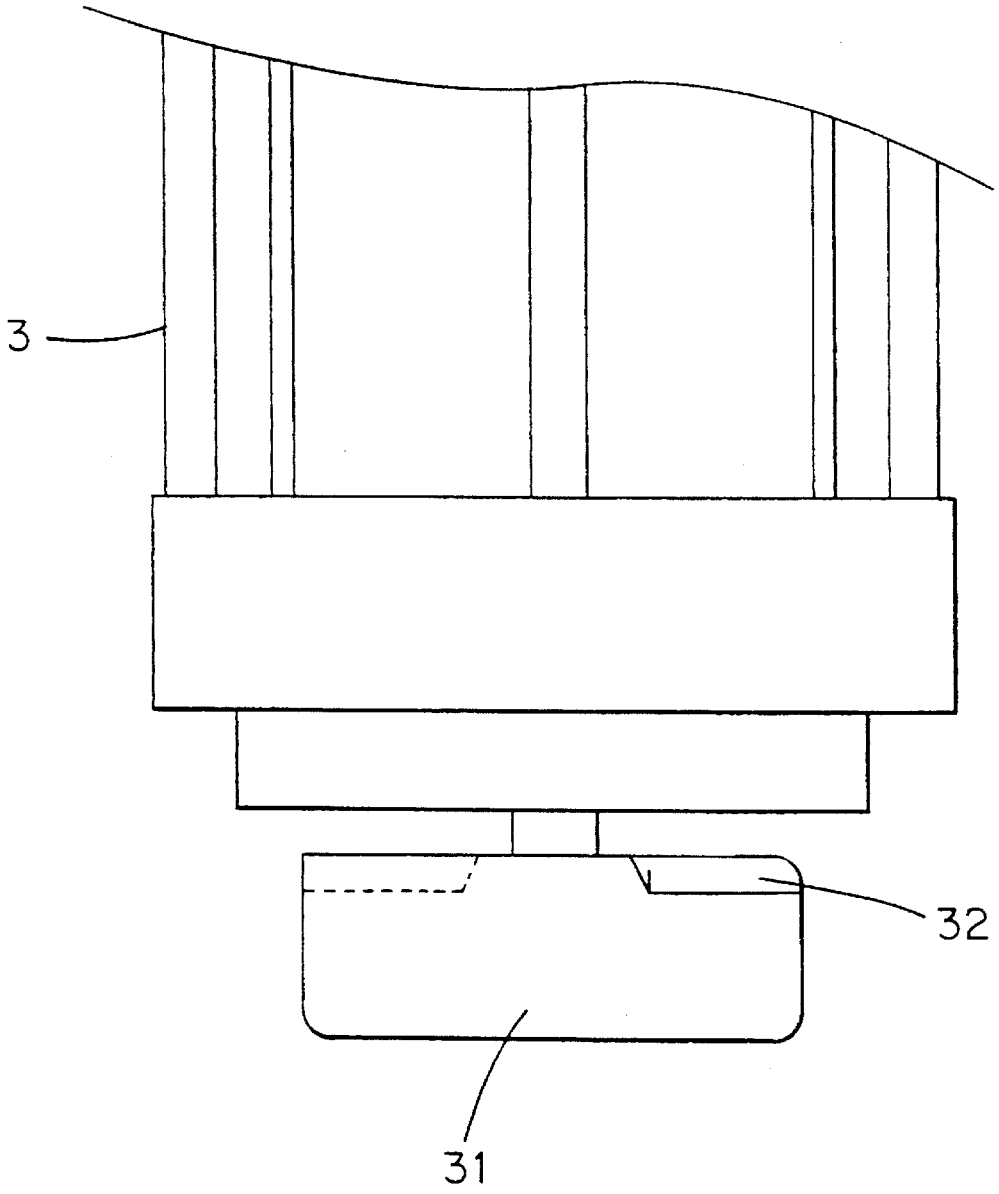
FIG. 3 is an enlarged view of the lower part of the upright support for the baseball holder shown in FIG. 2.
Figure 4:
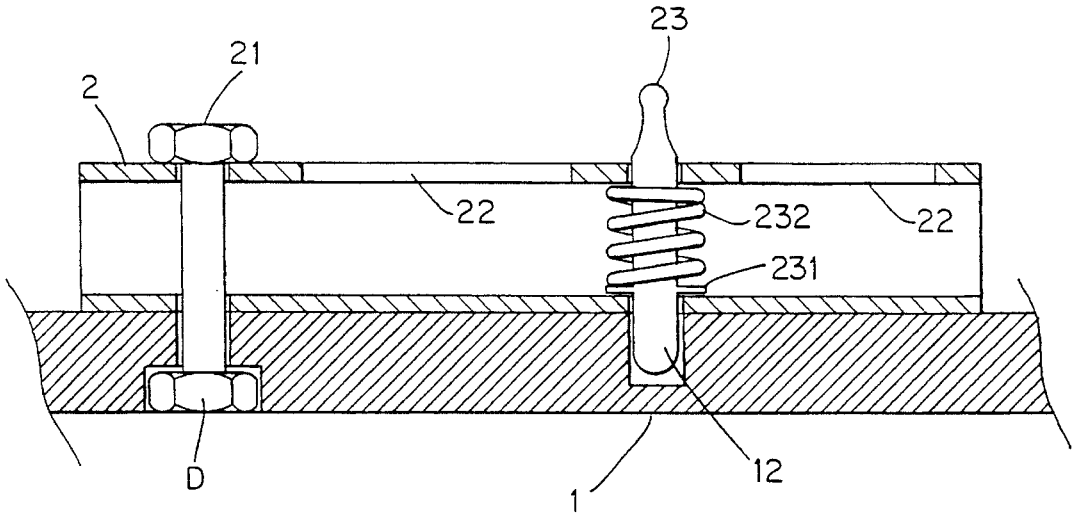
FIG. 4 is a sectional view of the swivel mount and home plate of the baseball holder shown in FIG. 2, showing the swivel mount locked.
Figure 5:
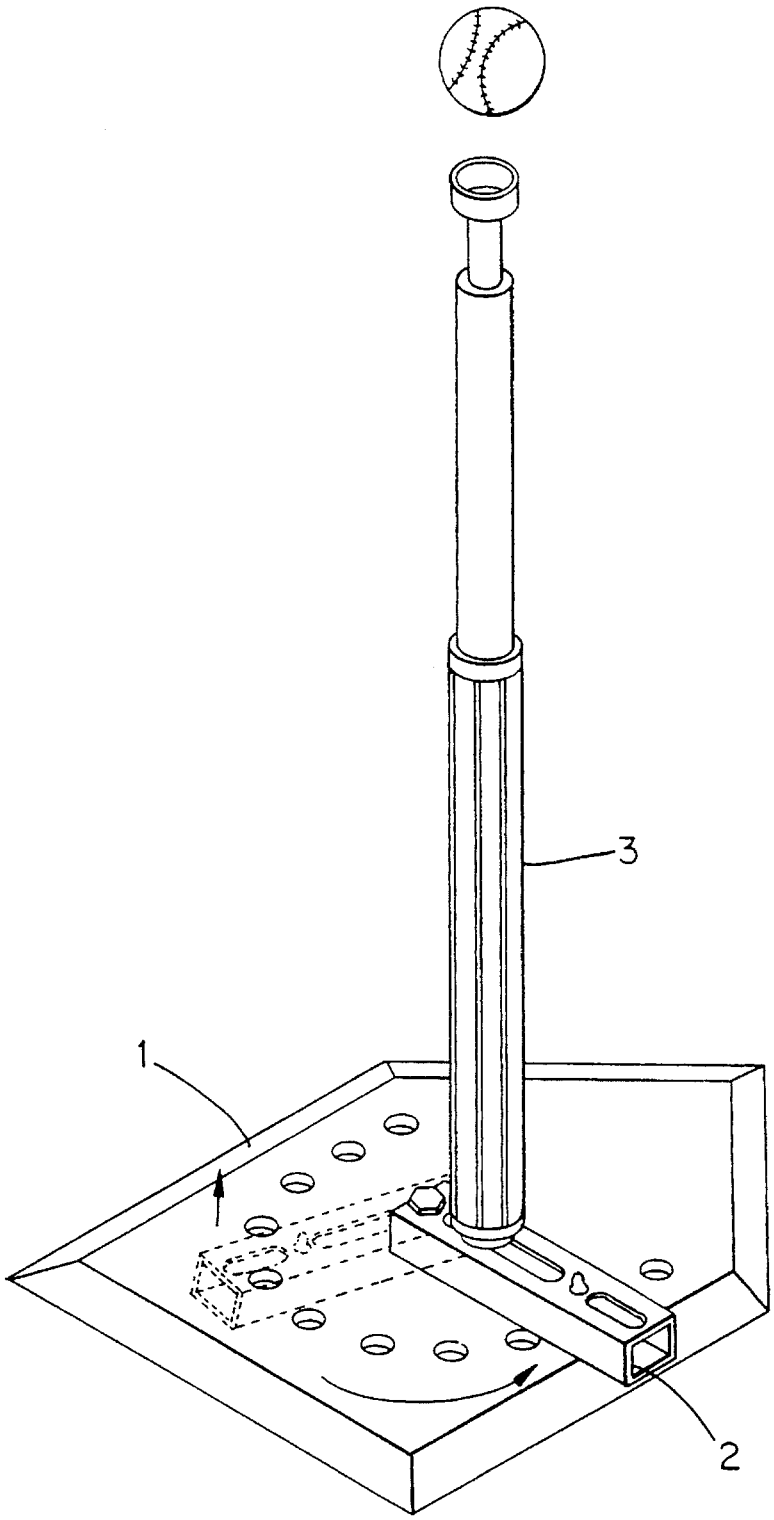
FIG. 5 is an applied view of the baseball holder shown in FIG. 2, showing the swivel mount adjusted.

Referring to FIGS. 2, 3, 4, and 5, a baseball holder for baseball batting practice in accordance with the present invention is generally comprised of a home plate (1) a swivel mount (2) and an upright support (3). The home plate (1) comprised a mounting hole (11) at the center for mounting a pivot bolt (21) and a plurality of locating holes (12) spaced around the mounting hole (11). The mounting hole (11) has an expanded bottom end (11) for receiving a nut (D) which is screwed up with the pivot bolt (21) being inserted in the mounting hole (11) The swivel mount (2) is a hollow, flat, elongated block turned about the bolt (21) having two elongated mounting slots (22) longitudinally aligned at the top for mounting the upright support (3). A locating bolt (23) is mounted on the swivel mount C2) and forced by a spring (232) into one locating hole (12) on the home plate (1). The spring (232) is mounted inside the swivel mount (2) and stopped between a collar (231) on the locating bolt (23) and the top side of the swivel mount (2). Therefore, the spring (232) gives a downward pressure to the collar (231) causing the locating bolt (23) inserted into one locating hole (12) The upright support (3) is comprised of two sections longitudinally connected together by a screw joint for supporting a baseball for batting. The bottom end of the upright support (3) terminates in a headed coupling rod (31) having two opposite sloping friction surface portions (32). By inserting the headed coupling rod (31) of the upright support (3) into one mounting slot (22) on the swivel mount (2) and then rotating the upright support (3) the sloping friction surface portions (32) are engaged with the inside wall of the swivel mount (2) and therefore the upright support (3) is fixed to the swivel mount (2). By pulling the locating bolt (23) upwards from home plate (1) and then moving it from one locating hole (12) to another, the angular position of the swivel mount (2) is adjusted (see FIG. 5). Furthermore, the sloping friction surface portions (32) of the headed coupling rod (31) are disengaged from the inside wall of the swivel mount (2) the headed coupling rod (31) can be moved in one elongated mounting slot (22) or from one elongated mounting slot (22) to another to change the distance between the upright support (3) and the pivot bolt (21) (namely, the horizontal distance between the center of the home plate (l) and the baseball on the upright support (3)).

It is to be understood that the drawings are designed for purposes of illustration only, and are not intended as a definition of the limits and scope of the invention disclosed.

I claim:

1. A baseball holder comprising a home plate, an upright support for supporting a baseball for batting, and a mount fastened to said home plate to hold said upright support in place, wherein said home plate has a pivot bolt at the center and a plurality of locating holes spaced around said pivot bolt; said mount is made of a hollow, flat, elongated block turned about said pivot bolt, having two elongated mounting slots longitudinally aligned at a top side thereof for mounting said upright support and a spring-supported locating bolt inserted into one locating hole on said home plate; said upright support has a bottom end terminating in a headed coupling rod inserted in one longitudinal mounting slot on said mount and moved therein and then firmly secured to said mount by friction through a rotary motion.

* * * * *